US008551053B2

(12) United States Patent
Hansen

(10) Patent No.: US 8,551,053 B2
(45) Date of Patent: Oct. 8, 2013

(54) DOUBLE CHAMBER AMPOULE

(76) Inventor: Bernd Hansen, Sulzbach-Laufen (DE)

( * ) Notice: Subject to any disclaimer, the term of this patent is extended or adjusted under 35 U.S.C. 154(b) by 1322 days.

(21) Appl. No.: 11/630,987

(22) PCT Filed: Jul. 26, 2005

(86) PCT No.: PCT/EP2005/008093
§ 371 (c)(1),
(2), (4) Date: Dec. 28, 2006

(87) PCT Pub. No.: WO2006/032320
PCT Pub. Date: Mar. 30, 2006

(65) Prior Publication Data
US 2008/0275404 A1 Nov. 6, 2008

(30) Foreign Application Priority Data
Sep. 21, 2004 (DE) ..... 10 2004 046 536

(51) Int. Cl.
*A61M 5/178* (2006.01)

(52) U.S. Cl.
USPC ..... 604/217; 604/140; 604/189

(58) Field of Classification Search
USPC ..... 604/69, 70, 140, 147, 189, 212, 213, 604/217; 128/200.21, 200.22, 200.23
See application file for complete search history.

(56) References Cited

U.S. PATENT DOCUMENTS

| | | | | |
|---|---|---|---|---|
| 2,707,469 | A | 5/1955 | Feinstein | |
| 3,993,223 | A * | 11/1976 | Welker et al. | 222/107 |
| 5,215,221 | A | 6/1993 | Dirksing | |
| 5,350,366 | A * | 9/1994 | Schlosser et al. | 604/203 |
| 5,582,330 | A | 12/1996 | Iba | |
| 6,419,167 | B1 * | 7/2002 | Fuchs | 239/323 |
| 6,786,369 | B2 * | 9/2004 | Garcia et al. | 222/632 |
| 2001/0027301 | A1 | 10/2001 | Lau et al. | |
| 2008/0132840 | A1 * | 6/2008 | Kirchhofer | 604/131 |
| 2009/0000615 | A1 * | 1/2009 | Pohlmann et al. | 128/200.21 |

FOREIGN PATENT DOCUMENTS

| | | |
|---|---|---|
| BE | 868 443 | 12/1978 |
| DE | 2 155 993 | 5/1973 |
| DE | 32 44 403 | 6/1984 |
| DE | 44 20 594 | 12/1995 |
| DE | 697 15 476 | 1/1998 |
| DE | 200 19 365 | 1/2001 |
| DE | 100 49 392 | 4/2001 |
| WO | WO 9007351 A1 * | 7/1990 |

* cited by examiner

*Primary Examiner* — Emily Schmidt
(74) *Attorney, Agent, or Firm* — Roylance, Abrams, Berdo and Goodman LLP

(57) ABSTRACT

A receptacle of an elastically flexible plastic includes a dosing chamber (10) with a medium to be discharged. One end of the dosing chamber (10) has a discharge opening (18). The opposite end is connected via a junction point (20) to a compressible receptacle part (22) with a gaseous propelling medium. When compressing the receptacle part (22), the propelling medium forces the medium to be discharged out of the dosing chamber (10) via the discharge opening (18). The junction point (20) between the dosing chamber (10) and the receptacle part (22) is a bottleneck creating a capillary effect independent of the spatial position of the receptacle preventing transfer of the medium of the dosing chamber (10) into the receptacle part (22).

13 Claims, 1 Drawing Sheet

DOUBLE CHAMBER AMPOULE

FIELD OF THE INVENTION

The present invention relates to a receptacle of an elastically flexible plastic material, with a dosing chamber in which a delivery medium is located. One end of the dosing chamber has a discharge opening. The opposite end is connected to a compressible receptacle part via a connecting point. A gaseous propellant medium is in the compressible receptacle part. When the receptacle part is compressed, the propellant medium at least partially displaces the delivery medium out of the dosing chamber via the discharge opening.

BACKGROUND OF THE INVENTION

DE-PS 32 44 403 discloses a generic receptacle of an elastic plastic material with a tubular dosing chamber in which a material medium is located. The material medium remains in the dosing chamber regardless of the location of the receptacle. A compressible receptacle part contains a gaseous medium having a larger volume than the dosing chamber. When the receptacle part is compressed, the material medium located in the dosing chamber is expellable from this dosing chamber through the discharge opening attached to it.

This known receptacle solution performs the function of delivering a material medium with a consistency that is ointment-like at ambient temperature and that is added exclusively to the dosing chamber when the receptacle is being produced. The consistency of the material medium that is ointment-like at ambient temperature prevents its emergence from the tubular dosing chamber which can also be conical towards the free end of the dosing chamber. In the known receptacle part, there is only the gaseous medium as a propellant medium so that when the receptacle is compressed, the material medium located in the dosing chamber by itself is removed essentially from this dosing chamber without essentially any residue remaining in the receptacle. The known solution is limited in that for delivery media in the dosing chamber with low viscosity relative to ointment-like consistency the delivery medium from the dosing chamber enters the receptacle part via an enlargement as the connecting point, mixes there with the propellant medium, and in this respect renders the receptacle solution unusable.

To counter this disadvantage, according to DE 44 20 594 C2, a plastic receptacle for meterable delivery of flowable substances has a discharge opening on one end. A chamber is connected to the other open end, and is open only toward the interior of the receptacle. The chamber volume can be reduced by manual deformation. The chamber is made in one piece with the receptacle. The receptacle is made as a cylinder. The interior of the cylinder holds the flowable substance separated from the interior of the chamber by a separating piston which can be moved manually lengthwise in the cylinder. In the chamber, air is stored which, when displaced by hand, presses the separating piston against the discharge opening of the receptacle. In this known solution, the material separation of the delivery medium in the dosing chamber from the propellant medium in the receptacle part is effected by this separating piston, so that mixing does not unintentionally occur. This mixing could make the receptacle solution unusable. With the known receptacle solution, it is possible to therefore deliver even a very thin liquid delivery medium. The disadvantage of this known solution is that it is expensive to produce due to the separating piston, and is axially large, especially in the delivery direction.

SUMMARY OF THE INVENTION

An object of the present invention is to provide a receptacle which can be economically produced, which can be made structurally small and which permits delivery of delivery media with a thin liquid consistency and/or in the form of an aerosol without major engineering effort.

This object is basically achieved by a receptacle where the connecting point between the dosing chamber and the receptacle part is formed from a constriction designed such that a capillary action is formed. Independently of the three-dimensional location of the receptacle, the capillary action prevents overflow of the delivery medium from the dosing chamber into the receptacle part with the propellant medium. Even without the separating piston configuration, the delivery medium cannot flow unintentionally from the dosing chamber in the direction of the receptacle part with the propellant medium. Regardless of the three-dimensional configuration of the receptacle, operating reliability is thus ensured in each instance. It is therefore surprising for one with average skill in the art in the area of producing these receptacles that he can deliver even sprayable aerosols or the like in this way as the delivery medium. The aerosol materials are becoming increasingly important in the field of pharmacy since it is possible in this way to bring sprayable active ingredients into contact with the nasal mucosa to ensure prompt uptake of the ingredient in this way. This uptake is not ensured in absorption of a different type.

In one preferred embodiment of the receptacle of the present invention, the constriction is formed from a capillary tube. Preferably, the vulnerable constriction is stiffened by a support device. This support device ensures that the constriction cannot be unintentionally damaged or compressed. This compression could damage its operation.

In one preferred embodiment of the receptacle of the present invention, the support device has at least two cross-piece-like support arms encompassing at least parts of the receptacle part, the constriction and also the dosing chamber. Preferably, the two support arms extend along a separating plane and at least partially overlap it, along which the parts of the receptacle half abut. In addition to the stiffening of the entire receptacle, this arrangement allows improved sealing of the receptacle contents relative to the exterior so that the sterility of the receptacle interior is also ensured over a longer time.

In another preferred embodiment of the receptacle of the present invention, in an extension of the receptacle part on its side facing away from the dosing chamber, the two support arms undergo transition into a tab provided with coding. The coding receptacle permits identification relative to its contents.

In another, especially preferred embodiment of the receptacle of the present invention, the dosing chamber tapers conically at least in increments toward the discharge opening. Depending on the degree of the selected conical tapering, when the receptacle is compressed an increase in velocity for the stored medium is achieved in this way. This acceleration benefits yield. In particular, an enhanced jet action can be achieved in delivery.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure and which are schematic and not drawn to scale.

DETAILED DESCRIPTION OF THE INVENTION

Figure 1:
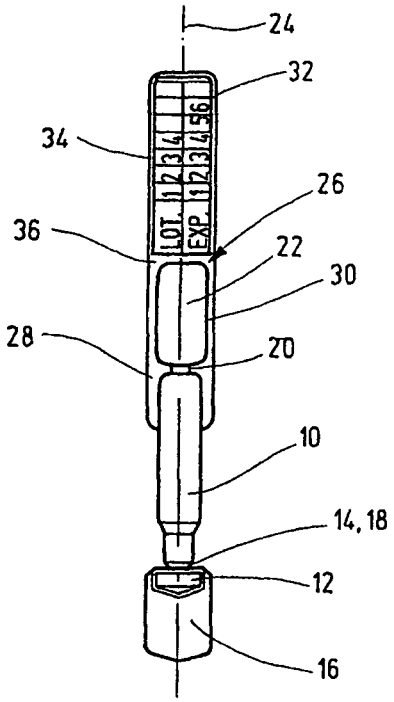
FIG. 1 is a front elevational view of a receptacle according to an exemplary embodiment of the present invention.

The receptacle shown in the figures is made of a transparent, elastically flexible plastic material which can be produced, filled and sealed sterile, by itself (compare FIGS. 1 and 2) or together with other receptacles (compare FIG. 3) by a blow-filling-sealing molding machine. The receptacle has a tubular dosing chamber 10 which on its lower end as shown in the drawings is closed by a twist closure 12 having necked scoring 14 and a handle 16 for screwing off the twist closure 12 to clear the discharge opening 18 on the lower end of the dosing chamber 10. In the dosing chamber 10 is the delivery medium, for example, one with an ointment-like consistency, such as eye ointment. Preferably, the delivery medium has such a low viscosity, even in the form of an aerosol, that it can be delivered from the dosing chamber 10 via a discharge opening 18 from the receptacle in the form of a spray process. The tubular structure of the dosing chamber 10 would in this way facilitate introduction into body openings, such as the nasal opening or the like.

The opposite end of the dosing chamber 10 is connected via a connecting point 20 to a compressible receptacle part 22 in which an especially gaseous propellant medium, for example, in the form of air, is located. When the receptacle part 22 is compressed, for example, by hand, the propellant at least partially displaces the delivery medium from the dosing chamber 10 via the discharge opening 18 for an application process outward to the exterior. The connecting point 20 between the dosing chamber 10 and the receptacle part 22 is formed from a constriction as shown in the figures. The constriction is made such that a capillary action is formed. Independent of the three-dimension position of the receptacle, this capillary action of the constriction prevents overflow or flow of the delivery medium from the dosing chamber into the receptacle part 22 with the propellant medium. Likewise, the propellant medium cannot unintentionally emerge via the connecting point 20 in the direction of the dosing chamber 10 without compressing the receptacle part 22. In particular, the constriction is formed from a capillary tube located in the form of a neck in the transition area between the dosing chamber 10 and the receptacle part 22. The axial extension of the capillary tube along the separating plane 24 of the receptacle is in any case smaller than its free passage cross section for the delivery medium.

As is furthermore to be seen in the figures, the vulnerable constriction is stiffened by a support device 26. As shown especially in FIG. 1, the support device 26 has two bridge-like support arms 28, 30 encompassing both the receptacle part 22 and the connecting point 20, as well as at least the lower or adjacent third of the dosing chamber 10. As is to be seen in FIG. 2 in particular, the two support arms 28, 30 extend along the separating plane 24, and at least partially overlap the plane within this framework, so that at the point along which the parts of the receptacle half abut one another in production engineering, additional sealing via the support device 26 is achieved. On its lower end in the direction of FIG. 1, the two support arms 28, 30 undergo transition into one piece into the dosing chamber 10 via a conical tapered admission segment.

Figure 2:
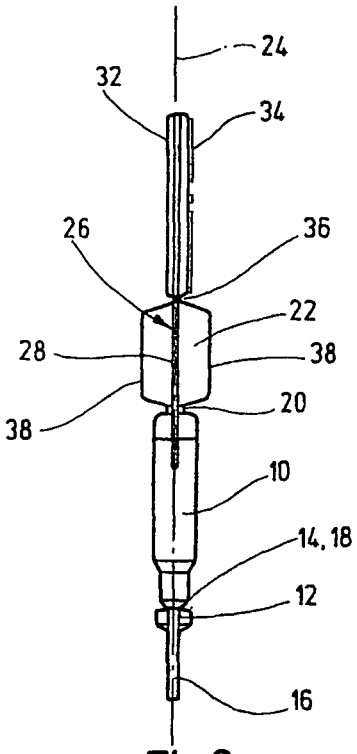
FIG. 2 is a side elevational view of the receptacle shown in FIG. 1.

In an extension of the container part 22 viewed in the direction of FIGS. 1 and 2 toward the top, the two support arms 28, 30 end in a flat, square or rectangular tab 32. In addition to improved handling for the receptacle, the tab 32 allows coding 34 to be attached to be able to identify the receptacle and its contents. The height of the tab 32 is selected such that as shown in FIG. 2 it projects with an end-side excess end over the separating plane 24 with the support device 26. Optionally, the tab 32 could be separated from the receptacle part 22 by another scored location 36. In contrast to the dosing chamber 10 which is made tubular, as well as the connecting point 20 in the form of the constriction, the receptacle part 22 is made essentially cuboidal. As shown in FIG. 2, opposing sides of receptacle part 22 has two contact surfaces 38 enabling the receptacle 22 to be compressed by hand, for example, with the user's thumb and index finger. The contact surfaces 38 in turn extend parallel to the plane of separation 24. In particular, the contact surfaces 38 project distinctly in both directions over the top of the dosing chamber 10. The volumetric ratios of the receptacle part 22 to the dosing chamber 10 are approximately 2:1 to be able to ensure complete discharge of the medium via the discharge opening 18.

Figure 3:
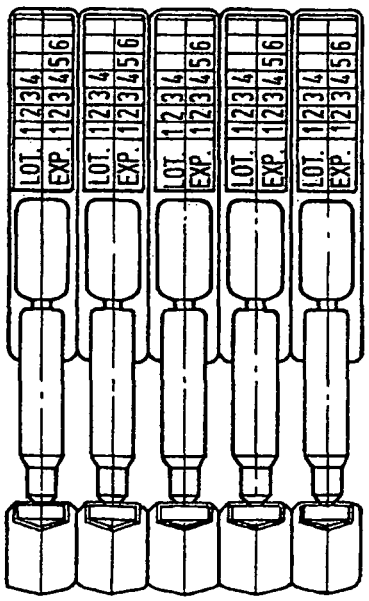
FIG. 3 is a front elevational view of several separable receptacles combined into a group with each receptacle being according to the configuration shown in FIGS. 1 and 2.

As shown in FIG. 3, several receptacles on their sides facing one another are connected to one another in succession. The receptacles produced in this way in a series by the blow molding machine are separable from one another via their adjoining faces. In this way, the user is enabled to individually separate and use receptacles combined into groups, preferably a week's supply. This combination permits cutting down on or reduction of packaging material.

With the receptacle solution of the present invention, the possible applications for the media deliveries are expected to increase for patients.

While one embodiment has been chosen to illustrate the invention, it will be understood by those skilled in the art that various changes and modifications can be made therein without departing from the scope of the invention as defined in the appended claims.

What is claimed is:

1. A receptacle of elastically flexible plastic material, comprising:

a dosing chamber containing a delivery medium and having opposite first and second ends;

a discharge opening at said first end of said dosing chamber;

a compressible receptacle part containing a gaseous propellant medium and coupled at said second end of said dosing chamber via a connecting point connecting said dosing chamber and said receptacle part in fluid communication, said connecting point being a capillary tube creating a capillary action independently of relative three-dimensional locations of said dosing chamber and said receptacle part to prevent flow of said delivery medium into said receptacle part; and a support device stiffening said capillary tube, said support device including at least two bridge-shaped support arms extending along at least part of a length of said receptacle part, all of a length of said capillary tube and at least part of a length of dosing chamber;

whereby upon compression of said receptacle part, said propellant medium displaces said delivery medium out of said dosing chamber via said discharge opening.

2. A receptacle according to claim 1 wherein
said support arms extend along a separating plane along which halves of the receptacle abut one another and at least partially overlap said separating plane.

3. A receptacle according to claim 1 wherein
said support arms have an extension on ends thereof facing away from said dosing chamber transitioning into a tab having coding thereon.

4. A receptacle according to claim 1 wherein
said dosing chamber is tubular; and
said receptacle part is essentially cuboidal.

5. A receptacle according to claim 4 wherein
said receptacle part projects at least in one direction over said second end of said dosing chamber.

6. A receptacle according to claim 1 wherein
volumes of said receptacle part to said dosing chamber have a ratio of at least 2:1.

7. A receptacle according to claim 1 wherein
a removable twist closure closes said discharge opening prior to opening thereof and discharge of said delivery medium.

8. A receptacle according to claim 1 wherein
said dosing chamber tapers at least in increments toward said discharge opening.

9. A receptacle according to claim 1 wherein
said delivery medium is a liquid.

10. A receptacle according to claim 1 wherein
said delivery medium is an ointment fluid.

11. A receptacle according to claim 1 wherein
the capillary action of said capillary tube also prevents flow of said propellant medium into said dosing chamber without compression of said receptacle part.

12. A receptacle according to claim 1 wherein
said dosing chamber, receptacle part, support arms and capillary tube are integrally formed of elastically flexible plastic.

13. A receptacle according to claim 1 wherein
said capillary tube is a cylinder.

* * * * *